US006484771B2

(12) United States Patent
Kloos et al.

(10) Patent No.: US 6,484,771 B2
(45) Date of Patent: Nov. 26, 2002

(54) GOLF CLUB COVER

(76) Inventors: Randolph C. Kloos, 998 Alta Vista Dr., Craig, CO (US) 81625; Richard H. Shields, 11087 S. Phoebes Dr., Conifer, CO (US) 80433

( * ) Notice: Subject to any disclaimer, the term of this patent is extended or adjusted under 35 U.S.C. 154(b) by 0 days.

(21) Appl. No.: 09/785,870

(22) Filed: Feb. 14, 2001

(65) Prior Publication Data

US 2002/0108689 A1 Aug. 15, 2002

(51) Int. Cl.[7] ..... B65D 65/02
(52) U.S. Cl. ..... 150/160; 206/315.4
(58) Field of Search ..... 150/160, 154, 150/158, 159, 161; 206/315.4, 315.5, 315.2, 315.3

(56) References Cited

U.S. PATENT DOCUMENTS 3,774,913 A * 11/1973 Dien ..... 473/285
4,213,614 A * 7/1980 Philippi ..... 150/160
4,667,716 A * 5/1987 Solheim et al. ..... 112/475.08
4,984,684 A * 1/1991 Conner et al. ..... 206/315.3
5,195,568 A * 3/1993 Cirone ..... 150/160
5,586,674 A * 12/1996 Nachbauer ..... 206/315.3
5,817,379 A * 10/1998 Rich et al. ..... 206/315.5
6,138,727 A * 10/2000 Shih ..... 15/209.1

FOREIGN PATENT DOCUMENTS

GB 2233239 * 9/1991 ..... 150/160

* cited by examiner

*Primary Examiner*—Lee Young
*Assistant Examiner*—Lien Ngo
(74) *Attorney, Agent, or Firm*—Angus C. Fox, III

(57) ABSTRACT

A protective cover for the head of a golf club having a main body formed a single piece cut from a sheet of foam rubber material, and a stretchable nylon or polyester fabric is bonded to the opposing surfaces of the foam rubber sheet. The single piece of sheet foam rubber material is folded along a substantially straight first edge and stitches along second and third edges to form a cover having a profile similar to that of the club head which it is to cover. The cover has an opening at the top thereof. The opening can be expanded in size to fit over the head of a club. The cover is also preferably equipped with a pocket. The pocket is sized to received a turf comb, which can be used to dress the grass on which the participants ball rests. The turf comb may be connected with a line or string to an anchor point within the pocket to reduce the possibility that the comb may fall from the pocket and become lost. In addition the cover may also be equipped with a male snap fastener which mates with a female snap fastener attached to the pocket.

17 Claims, 3 Drawing Sheets

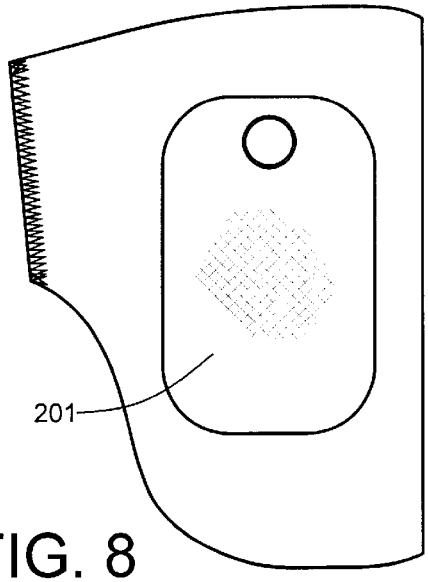
FIG. 8
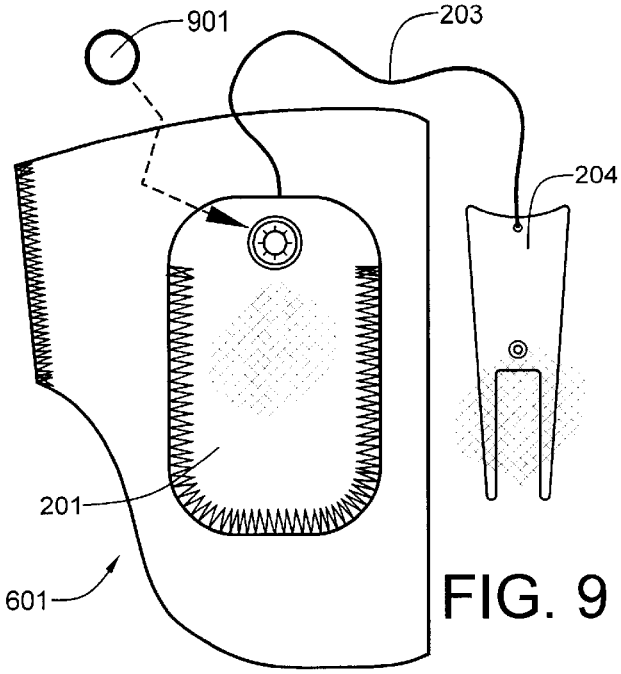
FIG. 9
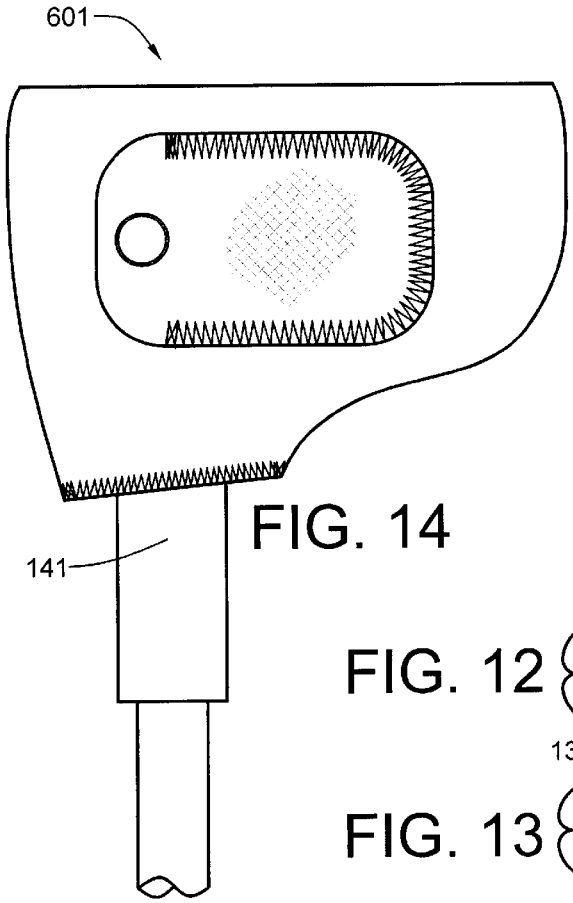
FIG. 14
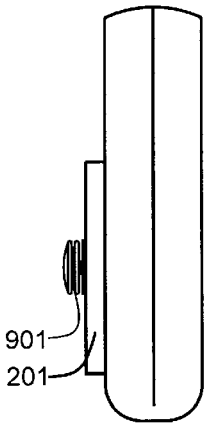
FIG. 11
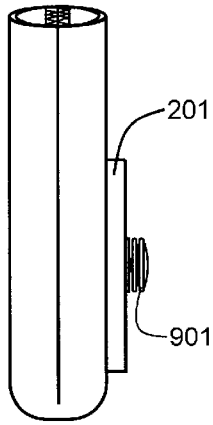
FIG. 10
FIG. 12
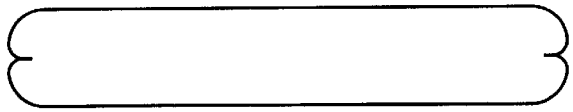
FIG. 13
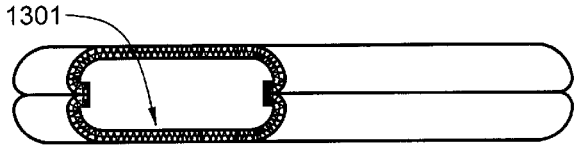

GOLF CLUB COVER

FIELD OF THE INVENTION

This invention relates to equipment used for the sport of golf and, more particularly, to covers used to protect the heads of golf clubs of both the putter and driver types.

BACKGROUND OF THE INVENTION

The use of padded covers for the protection of the striking heads of golf clubs is well known. The use of such covers is particularly desirable for "irons", as they are particularly susceptible to mutually-inflicted scratches and nicks which occur as multiple clubs are transported together. Though the ideal cover should be easily installed on the club head, remain securely in place once installed, be relatively simple and inexpensive to manufacture, and fit a wide range of different sized club heads, the many club head covers available in the marketplace reflect tradeoffs among those ideal characteristics.

Certain club head cover designs have focused on the various methos of retaining the cover in place on the head of the club. Some designs, such as those of U.S. Pat. No. 3,426,815 to Ashlin and U.S. Pat. No. 4,898,222 to Gaffney, rely on hook and loop fasteners. Each of these covers is somewhat complex, requiring the assembly of multiple components.

Certain club head covers and related innovations have been designed to address a particular problem, such as that of identifying a particular club while the cover is installed on the head thereof. U.S. Pat. No. 4,991,338 to Jones, U.S. Pat. No. 5,941,293 to Serpa, and U.S. Pat. No. 4,605,050 describe club head covers that are typical of this genre. The Jones head cover is equipped with a label plate holder into which label plates may be releasably locked therein. The Serpa head cover includes an uncovered aperture for viewing club head identification markings. The Suk cover includes a transparent window for viewing the club head identification markings.

Several club head covers have been fabricated from a resilient material such as neoprene. U.S. Pat. Nos. 5,195,568 and 5,105,863, both to Cirone, disclose such a covers. The snug fit provided by the elastic material secures the covers to the club head.

Another cover design, described by Spears in U.S. Pat. No. 3,593,769, uses a fastener attached to a flexible flap-like cover. Another cover, disclosed by Borenstein in U.S. Pat. No. 5,050,655, utilizes snaps to retain the cover on the head.

One-piece molded covers are disclosed in both U.S. Pat. No. 3,478,799 to Hoyt and U.S. Pat. 5,415,213 to Diener, et al.

Other club head covers have incorporated functions and/or accessories related to the game of golf. For example, U.S. Pat. No. 5,690,559 discloses a head cover which incorporates a rake which can be used to groom the surface of a sand trap.

SUMMARY OF THE INVENTION

The present invention provides a protective cover for the head of a golf club. The design, though applicable to all types of golf clubs, is primarily designed for use on putter clubs. The cover has a main body formed from a single piece cut from a sheet of foam rubber material. Because of its great elasticity, strength, stability and resistance to damage from ultraviolet radiation and weathering, neoprene rubber is the preferred compound from which the foam is manufactured. Nevertheless, polybutadiene rubber, a highly elastic rubber having characteristics similar to natural rubber, may be substituted for neoprene. For a preferred embodiment of the invention, a stretchable nylon or polyester fabric is bonded to the opposing surfaces of the foam rubber sheet. The single piece of sheet foam rubber material is folded along a substantially straight first edge and stitched along opposite second and third edges to form a cover having a profile similar to that of the club head which it is to cover. Generally speaking, the cover has somewhat the same profile as a baby bootie. Like the bootie, the cover has an opening at the top thereof. The opening can be expanded in size to fit over the head of a club. Because of the elasticity of the material from which the cover is made, and because the cover is slightly smaller than the head which it covers, the cover will conform to the shape of the club head.

The cover may also be equipped with a pocket. The pocket may be formed from the same type of material as the cover, and may be either adhesively bonded or sewn to the cover. The pocket is sized to receive a turf comb, which can be used to dress the grass on which the participants ball rests. The turf comb may be connected with a line or string to an anchor point within the pocket to reduce the possibility that the comb may fall from the pocket and become lost. In addition, the cover may also be equipped with a ball marker. For a preferred embodiment of the invention, the marker is a male snap fastener which mates with a female snap fastener that is attached to the pocket.

DESCRIPTION OF THE DRAWINGS

FIG. 8 is a right-side elevational view of the cut piece of FIG. 1 following stitching of the opening edges, folding it along its line of symmetry, stitching a pair of side seams, turning the assembly inside out, and adhesively attaching the pocket piece and snap of FIG. 2;

FIG. 9 is a right-side elevational view of the completed putter head cover of FIG. 6, showing a snap-on ball marker and a turf comb attached to the snap anchor with a string;

FIG. 10 is a front elevational view of the putter head cover having the pocket and a snap-on ball marker attached thereto;

FIG. 11 is a rear elevational view of the putter head cover having the pocket and a snap-on ball marker attached thereto;

FIG. 12 is a bottom plan view of the putter head cover, complete with the attached pocket and snap-on ball marker;

FIG. 13 is a top plan view of the putter head cover, complete with the attached pocket and snap-on ball marker; and FIG. 14 is a side elevational view of the putter head cover installed on the head of a putter club.

DETAILED DESCRIPTION OF THE INVENTION

The invention and its construction will now be described in detail with reference to the attached drawing FIGS. 1 through 14.

Figure 1:
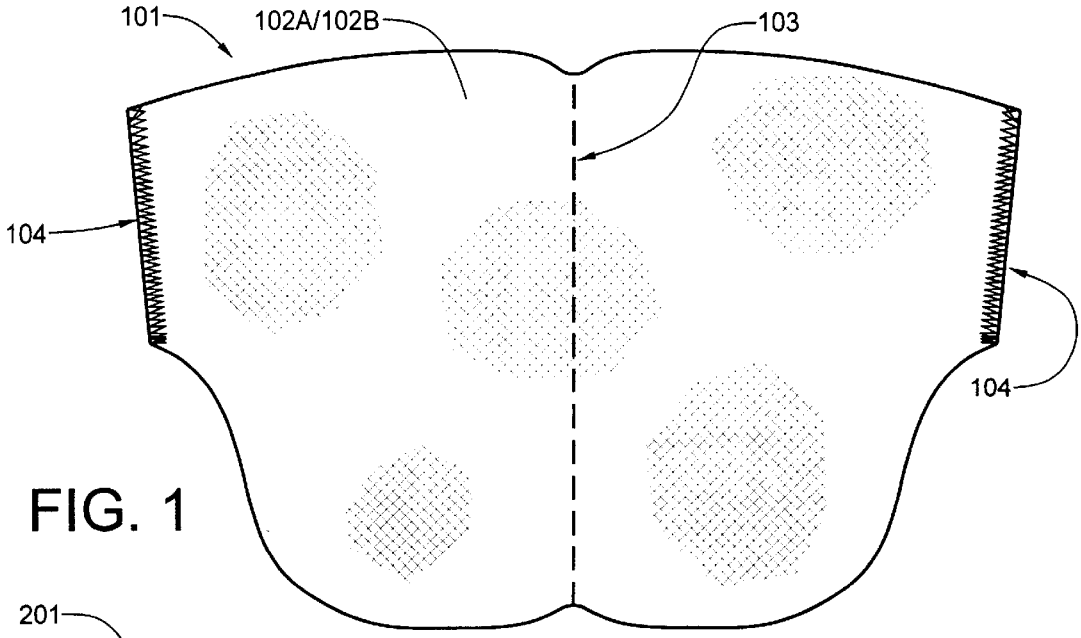
FIG. 1 is a top planar view of a cut piece of sheet of fabric-backed foam material used to form a preferred embodiment of a putter head cover.

Referring now to FIG. 1, a main body piece 101 is cut from a laminar sheet of foam rubber material having double fabric backings 102A and 102B in the shape depicted. The presently preferred rubber compound is neoprene (also known as polychloroprene). Neoprene is highly elastic, and resistant to heat, weathering and abrasion. Other rubber compounds, which have high elasticity, may be substituted for neoprene. One such compound is polybutadiene rubber, a rubber that closely resembles natural rubber in many properties. In addition to being highly elastic, it is also resistant to abrasion, heat and cold. The fabric backing used on both sides of the foam rubber material is preferably a stretchable knit fabric made of one or more polymeric compounds such as polyester or nylon. The main body piece 101 will become the main body of the putter head cover, and is shaped somewhat like a tiny grand piano lid mirrored back-to-back about its longest straight edge, which is the fold line 103, and an axis of bilateral symmetry. What will become the opening edges 104 are stitched to prevent the backing material 102A and 102B from fraying.

Figure 2:
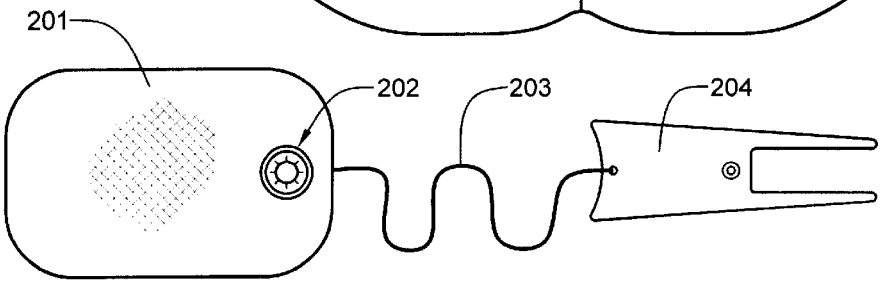
FIG. 2 is a top planar view of a pocket piece for the putter head cover, as cut from a sheet of fabric-backed foam material, said pocket piece having a female snap installed thereon and a turf comb attached to the snap anchor with a string.

Referring now to FIG. 2, a generally rectangular pocket piece 201, which has radiused corners, will be attached to the cut piece of FIG. 1 and thereby become a pocket. The pocket piece 201 is preferably cut from the same fabric-backed, foam rubber sheet material as that from which the main body piece 101 is cut. A female snap 202 has been attached at one end of the pocket piece. One end of a line or string 203 is attached to the snap retainer (not shown), and a turf comb 204 is attached to the opposite end thereof.

Figure 3:
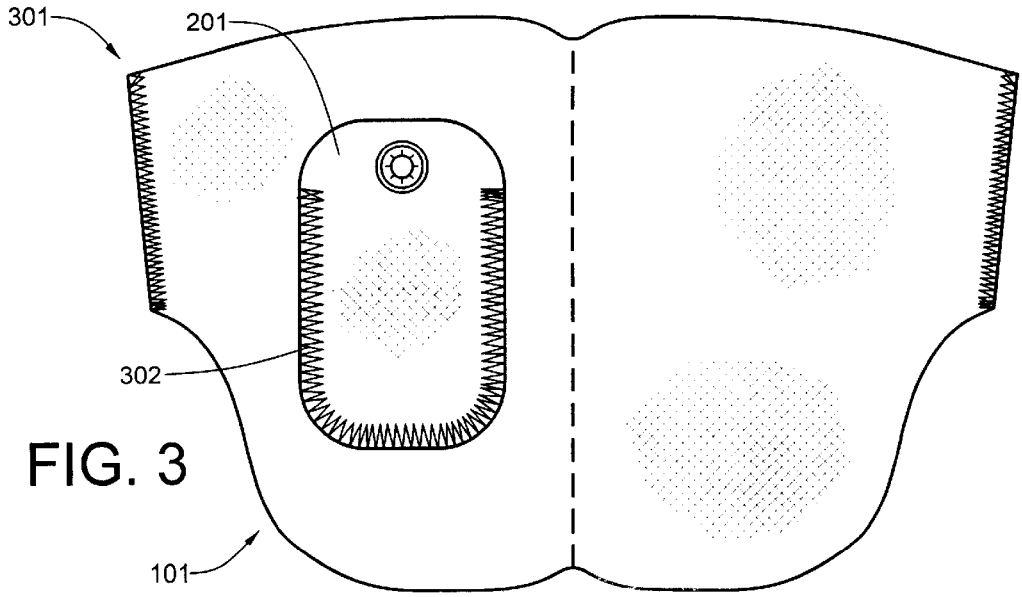
FIG. 3 is a top planar view of the cut piece of FIG. 1 following stitching of the opening edges and attachment of the pocket piece of FIG. 2 thereto with stitching.

Referring now to FIG. 3, an intermediate assembly 301 for a first preferred embodiment of the invention is created by attaching the pocket piece 201 to the main body piece 101 with a U-shaped stitching pattern 302. It will be noted that although, the pocket piece 201 carries the attached female snap 202, neither the string 203, nor the turf comb 204 are shown in this view.

Figure 4:
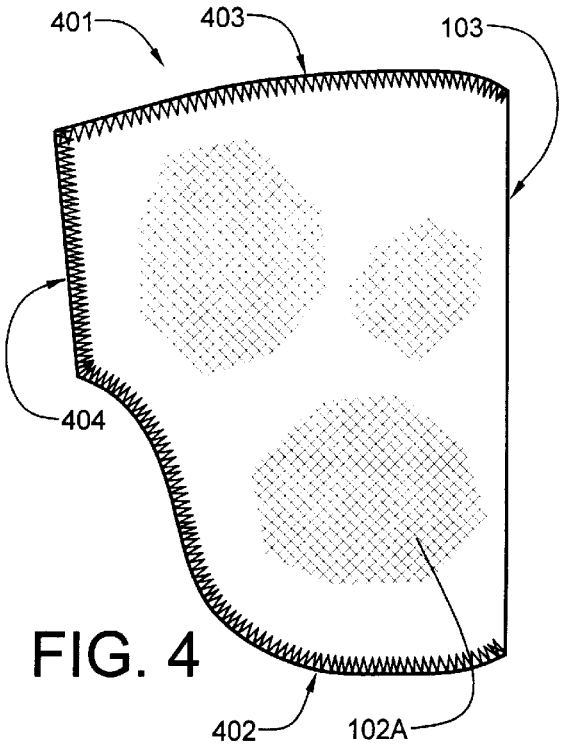
FIG. 4 a right-side elevational view of the the cut piece of FIG. 1 or the assembly of FIG. 3 after stitching the stitching the opening edges, folding it along its line of symmetry, and stitching a pair of side seams.

Referring now to FIG. 4, an intermediate assembly 401 for an alternative, second preferred embodiment of the invention is created by folding the main body piece 101 of FIG. 1 along its fold line 103 and stitching along a first side 402 and a second side 403, leaving an opening 404 where the folded parts are not joined. A single layer of fabric backing 102A is now visible.

Figure 5:
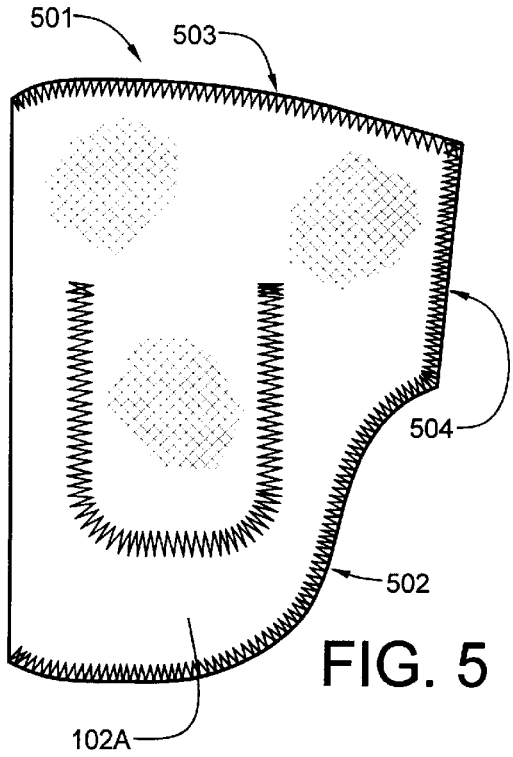
FIG. 5 is a left-side elevational view of the assembly of FIG. 3 after stiching the opening edges, folding it along its line of symmetry, and stitching a pair of side seams.

Referring now to FIG. 5, a completed, inside-out in-process assembly 501 is created by folding the intermediate assembly 301 of FIG. 3 along its fold line 103 and stitching along a first side 502 and a second side 503, leaving an opening 504 where the folded parts are not joined. A single layer of fabric backing 102A is now visible. It should be noted that FIG. 4 may also depict the opposite side of in-process assembly 501, as no pocket stitching is visible on that side.

Figure 6:
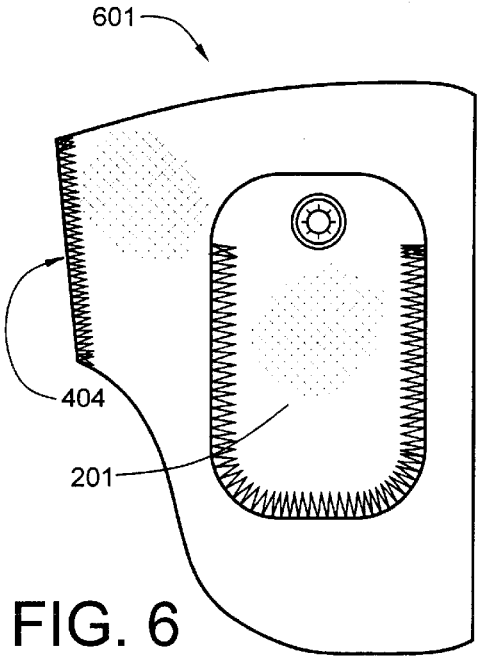
FIG. 6 is a right-side elevational view of the assembly of FIG. 5 after it is turned inside out.
Figure 7:
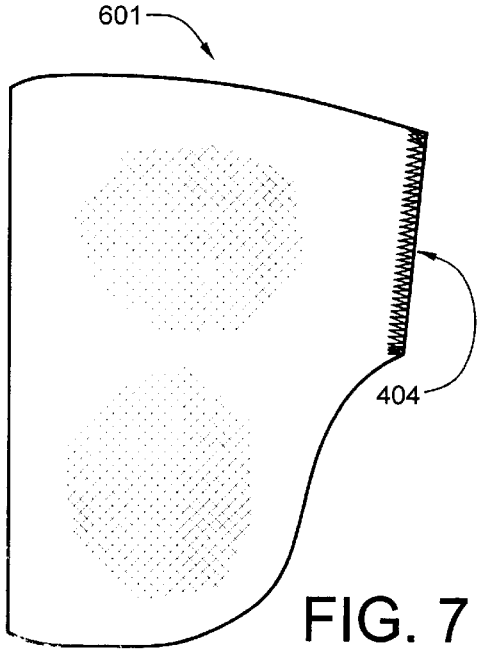
FIG. 7 is a left-side elevational view of the assembly of FIG. 4 or of FIG. 5 after it is turned inside out.

Referring now to FIG. 6, the in-process assembly 501 of FIG. 5 has been turned inside out, resulting in a main putter head cover body 601 having its final shape. It will be noted that the only stitching now visible is that which attaches the pocket piece 201 and that which is along the opening edges Referring now to FIG. 7, the opposite, pocketless side of the putter head cover body 601 of FIG. 6 is shown. It may also be the opposite, pocketless side of the putter head cover body 401 of FIG. 4.

Referring now to FIG. 8, the intermediate assembly of FIG. 4 has been completed by adhesively attaching three edges of the pocket piece 201 of FIG. 2.

Referring now to FIG. 9, the main putter head cover body 601 is shown in combination with a male snap-on ball marker 901 and the turf comb 204. Both the turf comb 204 and the string 203 can be inserted within the pocket created by the face of the cover body and the attached pocket piece 201.

The actual three-dimensional shape is more clearly shown in the front, rear, bottom and top view of FIGS. 10,11, 12 and 13, respectively. The opening 1301, through which a putter head may be inserted is clearly shown in FIG. 13. The snap-on ball marker 901 is also visible in the front and rear views of FIGS. 10 and 11.

Referring now to FIG. 14, a first embodiment of the putter head cover of FIG. 9 is shown fitted over the head of a putter club 141. The alternative embodiment of the putter head cover (shown in FIG. 8) is identical except for the means by which the pocket piece 201 is attached to the main cover body 401.

The advantages of the present invention are that it provides a head cover for putter golf clubs which is easily manufactured and which also provides the additional features of a pocket to hold a turf comb and to which a snap-on ball marker may be attached.

Although only several embodiments of the invention have been heretofore described, it will be obvious to those having ordinary skill in the art that changes and modifications may be made thereto without departing from the scope and the spirit of the invention as hereinafter claimed.

What is claimed is:

1. A golf club head cover comprising:

a main body formed from a single sheet of foam rubber material, said sheet having a stretchable fabric backing layer on each of two major surfaces thereof, said sheet having been folded along its axis of symmetry and stitched together on first and second mating edges, a portion of the mating edges remaining unattached to one another to form an opening through which the head of the club may be inserted;

a pocket affixed to said main body;

a turf comb enclosed within said pocket;

a cord attached to said comb which is also coupled to said main body.

2. The golf club head cover of claim 1, wherein said sheet incorporates a stretchable fabric backing on both sides thereof.

3. The golf club head cover of claim 1, wherein said pocket is generally rectangular.

4. The golf club head cover of claim 3, which further comprises a ball marker releasably affixed to said pocket.

5. The golf club head cover of claim 3, wherein said ball marker is a snap of a first sex which releasably attaches to a snap of the opposite sex affixed to said pocket.

6. The golf club head cover of claim 1, wherein said rubber foam is formed from one or more of the rubber compounds in the class consisting of neoprene and polybutadiene.

7. The golf club head cover of claim 2, wherein said stretchable fabric is a knit fabric formed from polymeric fibers.

8. The golf club head cover of claim 7, wherein said polymeric fibers are selected from the class consisting of polyester and nylon.

9. A golf club head cover comprising:

a main body formed from a single bilaterally symmetrical sheet of foam rubber material, said sheet having at least one stretchable fabric backing layer on a major surface thereof, said sheet having been folded along its axis of symmetry and stitched together on first and second mating edges, a portion of the mating edges remaining unattached to one another to form an opening through which the head of the club may be inserted;

a pocket affixed to said main body;

a turf comb insertable within said pocket;

a cord attached to said comb which is also coupled to said main body; and a reversably releasable ball marker affixed to said pocket.

10. The golf club head cover of claim 9, wherein said sheet of foam rubber material includes a stretchable fabric backing layer on both major surfaces thereof.

11. The golf club head cover of claim 9, wherein said pocket is generally rectangular.

12. The golf club head cover of claim 9, wherein said ball marker is a snap of a first sex which releasably attaches to a snap of the opposite sex affixed to said pocket.

13. The golf club head cover of claim 9, wherein said rubber foam is formed from one or more of the rubber compounds in the class consisting of neoprene and polybutadiene.

14. The golf club head cover of claim 9, wherein said stretchable fabric is a knit fabric formed from polymeric fibers.

15. The golf club head cover of claim 14, wherein said polymeric fibers are selected from the class consisting of polyester and nylon.

16. A golf putter head cover comprising:

a main body formed from a single sheet of foam rubber material, said sheet having a stretchable fabric backing layer on each of two major surfaces thereof, said sheet having been folded along its axis of symmetry and stitched together on first and second mating edges, a portion of the mating edges remaining unattached to one another to form an opening through which the head of the club may be inserted;

a pocket affixed to the main body;

a turf comb enclosed within said pocket;

a cord attached to said comb which is also coupled to said main body; and a reversably releasable ball marker coupled to said main body.

17. The golf putter head cover of claim 16, wherein said ball marker is a snap of a first sex which releasably attaches to a snap of the opposite sex affixed to said pocket.

* * * * *